US005358123A

United States Patent [19]

Stone

[11] Patent Number: 5,358,123

[45] Date of Patent: Oct. 25, 1994

[54] MODIFIED Z SECTION TENSION RINGS FOR SCREENS

[75] Inventor: Lawrence H. Stone, River Vale, N.J.

[73] Assignee: Kason Corporation, Linden, N.J.

[21] Appl. No.: 157,533

[22] Filed: Nov. 26, 1993

[51] Int. Cl.[5] ..... B07B 1/49

[52] U.S. Cl. ..... 209/403

[58] Field of Search ..... 209/403, 405, 409

[56] References Cited

U.S. PATENT DOCUMENTS

| | | | |
|---|---|---|---|
| 3,243,042 | 3/1966 | Moulten . | |
| 3,352,418 | 11/1967 | Swallow | 209/403 |
| 3,463,315 | 8/1969 | Riesbeck et al. | 209/403 X |
| 3,508,649 | 4/1970 | Kahane et al. | 209/403 X |
| 3,792,774 | 2/1974 | Rosenblum . | |
| 3,875,065 | 4/1975 | Rosenblum . | |
| 4,140,630 | 2/1979 | Scarlett et al. | 209/403 X |
| 4,929,346 | 5/1990 | Si-Lin . | |

*Primary Examiner*—D. Glenn Dayoan
*Attorney, Agent, or Firm*—Stanley J. Yavner

[57] ABSTRACT

A woven wire screen is held tightly on a circular tension ring mount and attached directly thereto by welding. A basic Z-shape for the tension ring is modified by a vertical partial drop from the inner part of the tension ring in order to prevent jamming of anti-blinding devices. The overall structure provides the necessary stiffness and is devoid of crevices and the like, which would not be suitable in a sanitary environment.

4 Claims, 1 Drawing Sheet

MODIFIED Z SECTION TENSION RINGS FOR SCREENS

FIELD OF THE INVENTION

This invention relates to screening structures and more particularly to such structures as are used for tension rings in a circular screen device, which enables "anti-blinding" devices to be used therewith.

BACKGROUND OF THE INVENTION

In the screen technology, a number of problems are solved by the use of a circular screen, made of woven wire, which is held tightly on a circular tension ring mount and attached by welding or bonding the like to that ring. A related technology involves what is referred to in the industry as "anti-blinding" structures, wherein a device is used to prevent clogging of the openings formed by the woven wire. One such device or structure for performing "anti-blinding" functions relates to the use of hollow rings which are disposed, each with a vertically oriented axis in a manner to clean the interstices of the woven wire by moving around just below the screen. Often, the tension ring holding the woven wire is made with a simple "Z-shape", wherein an upper and lower horizontal flange is connected by a vertical flange, with the screen mounted on the upper horizontal leg whose free end points toward the center of the ring. Such a structure has the disadvantage of a lack of stiffness, but also the disadvantage that, with "anti-blinding" devices as described above, the plastic rings jam up under the upper horizontal leg of the tension ring. Other structures for the same purpose use a hollow tension ring, wherein a hollow square structure is arranged under the upper horizontal leg of the tension ring to prevent jamming, and to add stiffness. However, manufacturing complexities result.

In more detail, when woven wire structures are in the large dimensional category, such as one and one-half feet or more diameter rings, the lack of complexity in manufacturing the tension ring becomes more critical-Furthermore, such large diameter screens are much more difficult to place in the proper tension for the various applications of the structure.

Manufacturing of such tension rings is usually related to two basic steps; namely, a first step involving the forming of the cross-sectional shape of the tension ring, and then, secondly, the rolling of such form into a perfectly circular shape. The complexities noted above take hold most particularly during the rolling process.

In terms of prior art, two Jesse Rosenblum U.S. Pat. Nos. 3,985,065 and 3,792,774, relate to the placing of screens in tension for supporting various materials. However, in both cases, the problem disclosed above concerning jamming during the "anti-blinding" function are not solved by the Rosenblum structures.

Likewise, Moulten U.S. Pat. No. 3,243,042 is also subject to the same drawback.

The Yu Si-Lin U.S. Pat. No. 4,929,346 concentrates more on solving a different set of problems, without addressing the problems solved by the present invention. Thus, the Si-Lin patent does not anticipate the structure of the present invention.

OBJECTS AND SUMMARY OF THE INVENTION

Accordingly, a primary object of the present invention is to provide a tension ring structure for a circular separating screen, which is simple to manufacture, relatively stiff and yet which can be used without jamming in connection with "anti-blinding" devices.

A further object of the present invention is to provide the above structure which is simple and yet efficient in its primary function of holding screen wire tautly for various separating functions.

These and other objects of the present invention are provided in a tension ring structure which features a basic "Z"-shape cross-section, with a lower horizontal outside leg, an inner and upper horizontal leg and a vertical leg connecting the horizontal legs, but with a slightly depending flange at the inner end of the upper and inner horizontal leg, for preventing the jamming of "anti-blinding" devices. The length of the depending flange is taught herein to provide a balance between considerations of stiffness of the structure, preventing jamming of "anti-blinding" devices, and ease of manufacture, and results in a preferred length of $\frac{1}{4}''$ for use with screens of diameters ranging from approximately two feet to six feet, with greater lengths for larger screens and lesser lengths for smaller circular screens.

BRIEF DESCRIPTION OF THE DRAWINGS

Other objects, features and advantages of the present invention will become apparent by the following detailed description of the preferred, but nonetheless illustrative, embodiment, with reference to the accompanying drawings, wherein.

DETAILED DESCRIPTION OF THE PREFERRED EMBODIMENT

Figure 1:
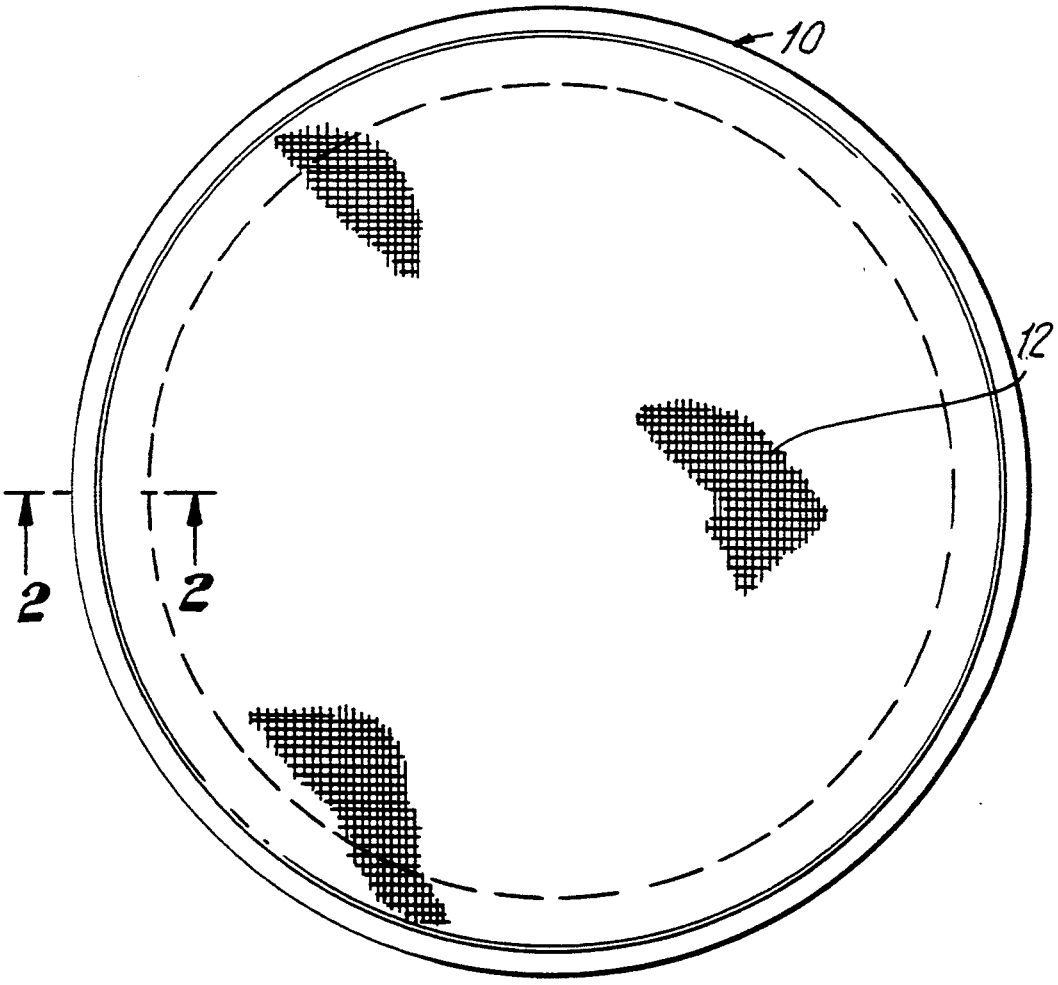
FIG. 1 is a top view of a circular screen useful with the present invention, as it is separated and stretched taut by a tension ring according to the present invention.

Referring to the drawings, FIG. 1 shows a top view of the screen structure according to the present invention. In terms of detail, the circular ring 10 is fixedly attached to wire mesh screen 12, which defines openings as formed by the woven mesh. The function of the tension ring 10 is to hold the woven wire under tension in order to provide a taut assembly. The connection between tension ring 10 and screen 12 is by means of welding or the like.

Figure 2:
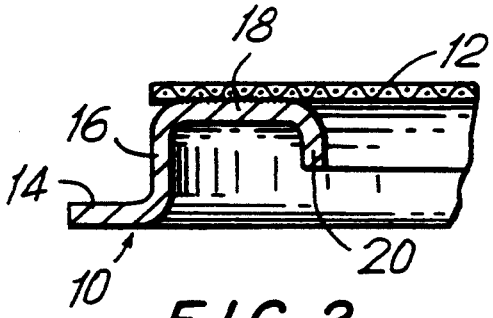
FIG. 2 is a sectional view, taken along the line 2—2 of FIG. 1 and showing particularly the unique cross-sectional shape of a tension ring formed according to the present invention.

FIG. 2 is a partial, sectional view of FIG. 1, wherein tension ring 10 is shown in cross-section to include lower and outer horizontal flange 14, vertical flange 16 and an upper and inner horizontal flange 18. Depending from upper and inner horizontal flange 18 is a vertical drop piece 20, which forms the basis for the structure and the accomplishments of the present invention.

Figure 3:
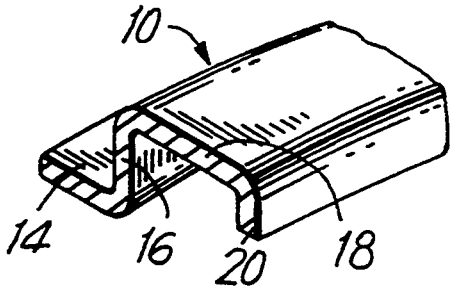
FIG. 3 is a front and right side isometric partial view of the tension ring according to the present invention.

The isometric, partial view of FIG. 3 illustrates a section of the tension ring, generally designated 10, as including lower flange 14, vertical flange 16, upper flange 18 and drop piece 20.

The manufacturing steps that can be used to form the structure of the present invention include an extrusion, roll forming, or other forming step to shape the cross-section to a form as shown in FIG. 3 and the result of the first step is rolled to provide an overall, nearly perfectly circular, tension ring, as is illustrated most clearly by FIG. 1.

With any suitable material used to form the present invention, the form as shown in the drawings and described herein is therefore lighter than, for instance, the conventional hollow tension ring mentioned in the introduction hereof; and the structure of the present invention is substantially devoid of crevices which might impair functioning in a sanitary environment, as is often necessary for certain food and other applications.

In more detail, the vertical drop piece 20 of the present invention measures approximately ¼" for screens and tension rings in the range of diameters between two to six feet. Greater lengths would be used for larger screens, with lesser lengths for smaller tension rings and screens.

A particular advantage of the present invention is that when various anti-blinding structures and forms are used to prevent clogging of the screen mounted on a tension ring having the shape of the present invention, such anti-blinding structures will not jam below flange 18, since they will be blocked from entry below such flange by drop piece 20, as they move around just below screen 12.

The above descriptions are not provided as limitations of the present invention, which are only to be provided by the scope of the following claims.

What is claimed is:

1. A tension ring structure for attachment to a screen used with anti-blinding devices operating just below said screen, comprising a cross-sectional shape including a lower, outer horizontal flange, a vertical flange, an upper, inner horizonal flange, separated from the level of said outer flange by a distance and to which said screen is directly attached and a drop piece depending from the innermost part of said upper and inner flange only part of the distance to level of said outer horizontal flange for preventing the jamming of said anti-blinding devices and for providing stiffness for said structure.

2. The invention according to claim 1 wherein said screen and said tension ring are circular in shape.

3. The invention according to claim 2 wherein said piece depends from said upper, inner horizontal flange by more than one-eighth of an inch, and said screen is more than approximately one and one-half feet in diameter.

4. The invention according to claim 1 wherein said screen is formed of woven wire and operates under tension provided by said ring.

* * * * *